United States Patent [19]

Fox

[11] 4,139,974

[45] Feb. 20, 1979

[54] STANDING T-RIB ROOF SYSTEM

[75] Inventor: John F. Fox, Riverdale, Ga.

[73] Assignee: Atlanta Metal Products, Inc., Atlanta, Ga.

[21] Appl. No.: 849,409

[22] Filed: Nov. 7, 1977

Related U.S. Application Data

[63] Continuation-in-part of Ser. No. 720,645, Sep. 7, 1976, abandoned.

[51] Int. Cl.[2] ..... E04C 2/08

[52] U.S. Cl. ..... 52/404; 52/468; 52/478; 52/519; 52/542

[58] Field of Search ..... 52/519, 520, 542, 465, 52/468, 404

[56] References Cited

U.S. PATENT DOCUMENTS

| | | | |
|---|---|---|---|
| 511,507 | 12/1893 | Cheeseman | 52/542 |
| 3,209,503 | 10/1965 | Mostoller | 52/520 |
| 3,849,956 | 11/1974 | Collins | 52/469 |
| 3,982,373 | 9/1976 | Wilson | 52/588 |
| 3,998,019 | 12/1976 | Reinwall | 52/478 |

FOREIGN PATENT DOCUMENTS

| | | | |
|---|---|---|---|
| 467506 | 12/1951 | Italy | 52/469 |
| 663390 | 12/1951 | United Kingdom | 52/469 |

*Primary Examiner*—John E. Murtagh

*Attorney, Agent, or Firm*—Newton, Hopkins & Ormbsy

[57] ABSTRACT

The side-by-side panels of a standing T-rib roof can be provided in any necessary lengths due to a smooth telescopically interfitting arrangement lengthwise between adjacent panel sections. One end portion of each panel section is tapered without cutting or crimping the metal thereof and when slipped endwise into the untapered end portion of another panel section forms a smooth slip joint of uniform cross sectional dimensions in relation to the complete assembled panel. An improved clip for attaching roof panels to underlying purlins features a vertical standoff space between the clip attaching feet and lateral panel support branches thereabove so that a thermal insulation blanket can be placed in the stand-off space. This vertical stand-off space greatly decreases the thermal conductivity of the metal roof and, therefore, increases the thermal value.

10 Claims, 7 Drawing Figures

40 FEET
RIDGE
L

STANDING T-RIB ROOF SYSTEM

CROSS-REFERENCE TO RELATED APPLICATION

This application is a contiuuation-in-part of prior copending application Ser. No. 720,645, now abandoned filed Sept. 7, 1976 for CLIP FOR STANDING RIB METAL ROOF PANELS.

BACKGROUND OF THE INVENTION

The objective of this invention is to improve on the construction of standing T-rib metal roofs in two important respects not heretofore known or utilized in the prior art.

In the past, where the roof area to be covered is of such size that each roof panel must be formed of plural sections which require lapping and joining endwise, difficulties are experienced, and the quality and appearance of the finished roof is adversely effected. The channel-like roof panels to be joined or lapped endwise require cutting and fitting on the job site in a rather haphazard and non-uniform manner, and the quality of the resulting joint or splice will depend largely on the skill of the particular roofer and varies from satisfactory to poor. Also much additional labor time is required.

By means of the present invention, this entire prior art problem is overcome in a very economical manner and a roof of superior quality and appearance can always be achieved without the need for highly skilled workers. Essentially, under the invention one end of each roof panel section to be joined telescopically and longitudinally with another panel section is smoothly tapered so that its cross sectional thickness is reduced sufficiently for entry lengthwise into the untapered end portion of another like roof panel section. The taper extends over a substantial portion of the length of the panel so as to be substantially unnoticeable to the eye of an observer, thus providing a smooth joint. No cutting, crimping or bending of metal on the job site is necessary, and the resulting joint or splice is perfectly smooth. Consequently, the finished roof is smooth and free of buckling or other like imperfections which have occurred in the prior art.

The second major feature of improvement embodied in the invention resides in the provision of an improved roof panel attaching or mounting clip which is concealed in the final roof assembly and which assures better lateral alignment of adjacent panels at a uniform height above supporting purlins. The clip provides a stand-off space between the bottoms of roof panels and the purlins, which space can receive an insulation blanket while simultaneously allowing better access to the heads of fasteners which secure the clips to the purlins. The vertical stand-off space lifts the metal roof off the metal purlins or other metal support structure and thereby reduces thermal conductivity in an area which has always presented a problem to the metal roof area. In actual experience in snow-load conditions on metal roofs the line of metal purlins can be visibly recognized because heat is conducted through the metal roof at the purlin area and the snow is melted over the purlin line. This visibly demonstrates the great heat loss in spite of insulation at the purlin area. By introducing a vertical stand-off this second major feature greatly increase the value of a metal roof with regard to thermal efficiency.

DETAILED DESCRIPTION

Figure 4:
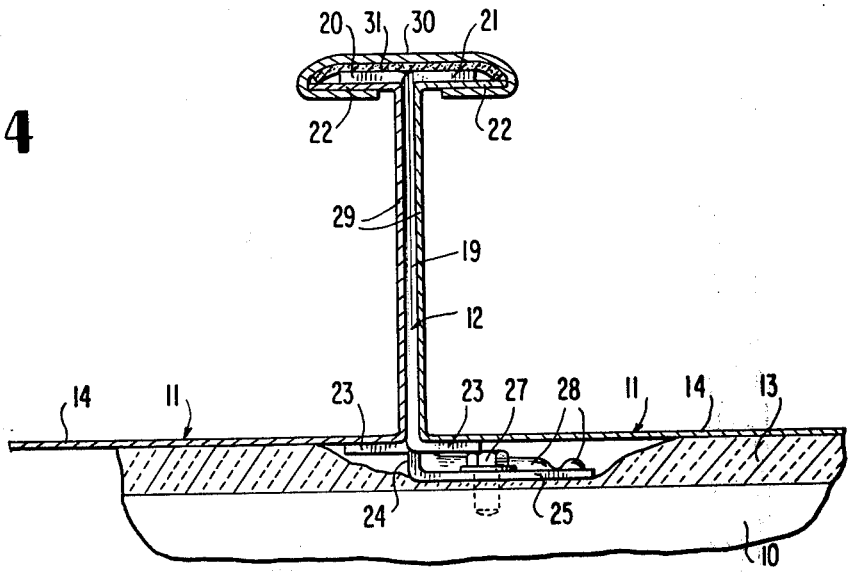
FIG. 4 is a similar section taken on line 4—4 of FIG. 1.
Figure 5:
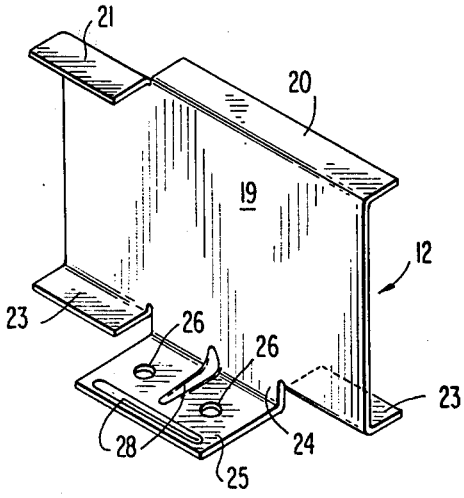
FIG. 5 is a perspective view of a panel supporting and attaching clip utilized in the invention.

Referring to the drawings in detail, wherein like numerals designate like parts, the numeral 10 designates one of a series of purlins which are arranged on equal centers and extend transversely beneath side-by-side parallel roof panels 11 arranged thereabove. The roof panels 11 are attached to the purlins 10 and supported thereon by an improved system of concealed clips 12, the construction and arrangement of which will be fully described. By virtue of the improved clips 12, a blanket 13 of suitable thermal insulating material can be arranged in a vertical stand-off space, FIG. 4, between the bottoms of the panels 11 and the purlins 10.

A major feature of the invention lies in the formation of a smooth and uniform slip joint or splice whenever required between adjacent longitudinal sections 14 of each roof panel 11. Each panel section 14 is customarily formed in a standard maximum length, such as forty feet. In such length, many roofs can be completely covered between ridge and eave by a single panel section 14 or a lesser length panel section achieved by cutting one of the sections 14. Substantially larger roofs require joining or splicing of two or more panel sections 14 according to the feature of the invention being discussed, as illustrated in FIGS. 1 and 2.

Figures 1, 1A, 1B, 2:
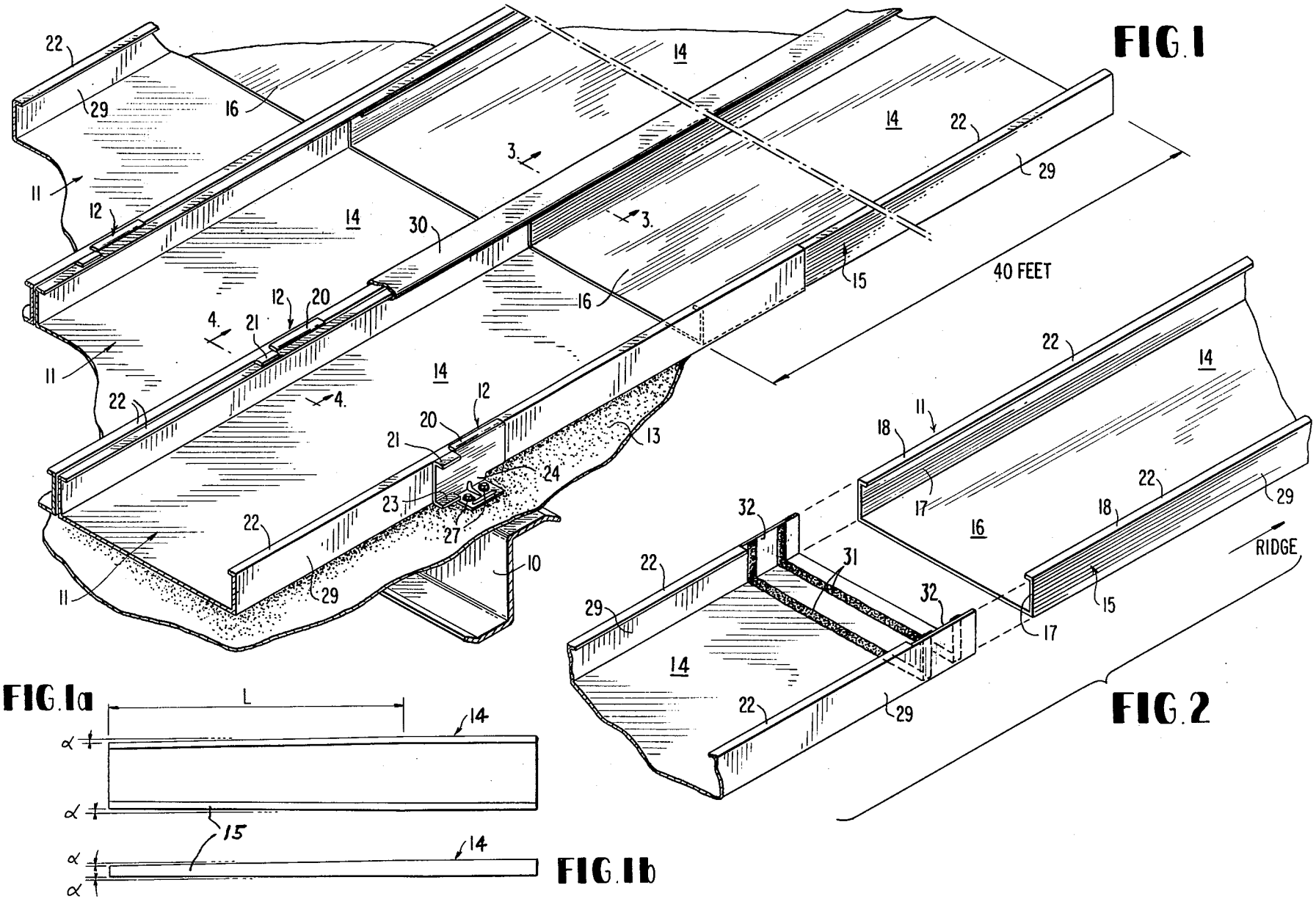
FIG. 1 is a fragmentary perspective view of a standing T-rib roof constructed in accordance with the invention.
FIG. 2 is an exploded perspective view of adjacent roof panel sections which are adapted to join endwise by telescoping to provide a smooth and uniform cross section joint or splice.
FIGS. 1*a* and 1*b* are diagrammatic plan and side elevational views of a roof panel section showing the tapering thereof width-wise and height-wise on an exaggerated scale.
Figure 3:
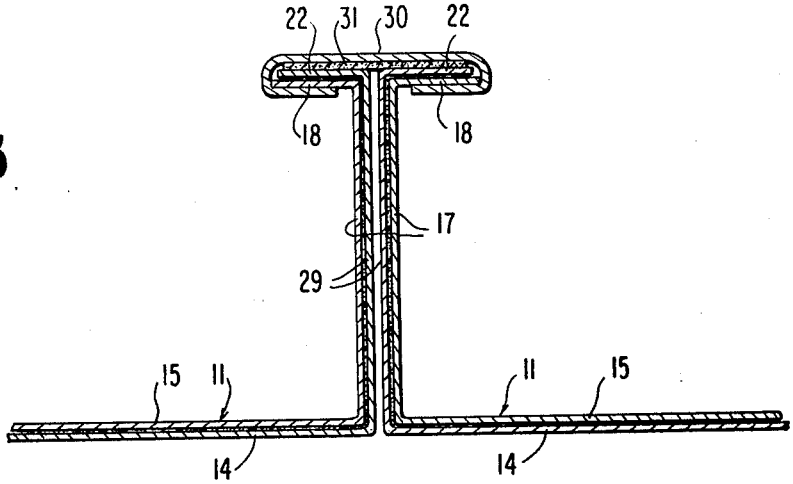
FIG. 3 is an enlarged transverse vertical section taken on line 3—3 of FIG. 1.

In producing the improved joint or splice between adjacent roof panel sections 14, FIGS. 1*a* and 1*b*, one end portion 15 of each panel section is slightly angled or tapered in width and height for the angle $\alpha$ over the longitudinal distance L. The distance L may vary in practice from a few feet to a major portion of the length of the panel section 14. The taper is exaggerated in FIGS. 1*a* and 1*b* for clarity. In producing the taper, no metal is cut, torn or crimped and the tapered portion 15 is smooth surfaced both externally and internally and of uniform wall thickness at the bottom wall 16, side walls 17 and top flanges 18, FIG. 2.

The channel-like cross sectional shape of each panel section 14 is conventional in the art. However, the formation of the tapered end portion 15 is completely new and allows each tapered end portion to be slipped endwise telescopically into an untapered end portion of another panel section 14, FIG. 1, to form a perfectly smooth and uniform cross section joint or splice between two panel sections 14. The untapered end portion of panel section 14, FIG. 2, is pre-notched as at 32 along the top flanges to allow ease of insertion of the telescopically formed tapered end portion 15. The pre-notching prevents the sealant strips 31 from becoming deformed upon assembly of mating panel sections 14 and 15, providing a superior vapor barrier. That is to say, the outside dimensions at the splice both widthwise and heightwise, are exactly the same as the outside cross sectional dimensions at the other extremity of the roof panel 11 formed by the invention. The longitudinal slip joint thus produced has the added advantage of providing a longitudinal fine adjusting means for the panel 11 between the ridge and eave of the roof. In a certain case, a forty foot roof panel can be spliced according to the invention with a second precut section 14 of a lesser length and in the final placement of the resulting panel 11 on the roof, any necessary lengthwise adjustment can be made by virtue of the telescopic slip joint afforded by the tapered reduced cross section end portion 15.

In conjunction with the above feature, the previously noted panel supporting and attaching clips 12 are utilized in the roof system to produce a superior roof in the completed state, both in terms of appearance and weather-proof integrity. Also, as previously explained, the clips 12 are fully concealed in the finished roof and provide a uniform height stand-off space for the insulation blanket 13 over the entire roof area between the bottoms of the panels 11 and the purlins 10.

Each clip 12 comprises a vertical body or wall 19 provided at its top with a pair of integral oppositely facing comparatively narrow panel locator or hold-down flanges 20 and 21. As shown clearly in FIG. 4, the clip flanges 20 and 21 lie immediately above the top flanges 22 of side-by-side adjacent panels 11 in the finished standing T-rib roof.

Each clip 12 further comprises a pair of integral oppositely extending lateral panel support flanges 23 at the bottom of the vertical wall 19 and at the ends of the clip in spaced superposed relation to the flanges 20 and 21. The two flanges 23 are at the same elevation and the bottoms of a side-by-side pair of roof panels 11 rests securely on the flanges 23 at a consistent elevation over the entire area of the roof to further provide uniformity and smoothness in the metal roof surface. In effect, the panel bottoms and their top flanges 22 are located and locked between the coacting flanges 20–21 and 23 of the clips 12 in the roof assembly.

Each clip 12 further comprises a vertical leg extension 24 positioned between the two support flanges 23 at the longitudinal center of the clip. At its lower end, the leg extension 24 carries a right angular attaching foot plate 25 which has a pair of spaced apertures 26 to receive fastener elements 27 which secure the clip fixedly to the underlying purlin 10. The foot plate 25 extends beyond one side only of the vertical wall 19 at right angles thereto and is in parallel relation to the flanges 21, 22 and 23. As shown clearly in FIG. 4, the lateral length of the foot plate 25 is considerably greater than the widths of the flanges 23. For increased rigidity, the foot plate is ribbed in two directions as at 28. When the clip 12 is fastened down on the purlin 10, as illustrated, there is a distinct stand-off space between the bottoms of the panels 11 and the tops of purlins to receive the insulation blanket 13 and to allow an additional thermal break, as described. There is also adequate clearance below the panels 11 for the heads of fasteners 27 and this also avoids denting or otherwise deforming the roof panels.

The clips 12 are constructed so that they can be placed on all roof purlins including any purlins which might be located at the splices between adjacent panel sectons 14. Since these telescopic splices formed by tapering the end portions 15 have the same outside dimensions as the remainder of the panel 11, the identical clips 12 may be used effectively in the region of the splices, as elsewhere, without modification. Therefore, it can be appreciated that the two major features of the invention, above-described, have a direct and intimate coaction which results in he ultimate formation of a greatly improved roof. While there are other constructional features and details in the complete roof system, this application is directed to the two main features which distinguish it from the known prior art.

When laterally adjacent panels 11 are arranged relative to the attaching clips 12 as shown in the drawings with the side walls 29 abutting opposite sides of the clip wall 19, the customary longitudinal cleat 30 is placed over the top flanges 22 of each side-by-side pair of panels 11 with a sealant strip 31 arranged between the cleat and the top flanges. The continuous cleat 30 also extends over the described telescopic splices in the roof panels when they are present, and over the clips 12, as illustrated. The cleats 30 are then closed beneath the flanges 22 or 18 by known machinery not shown and forming no part of this invention, to complete the formation of the improved standing T-rib roof.

It is to be understood that the formation of the invention herewith shown and described is to be taken as a preferred example of the same, and that various changes in the shape, size and arrangement of parts may be resorted to, without departing from the spirit of the invention or scope of the subjoined claims.

I claim:

1. In a standing T-rib roof, a plurality of side-by-side elongated channel cross section roof panels, each elongated roof panel consisting of at least a pair of longitudinally telescoping panel sections, each panel section having a slight taper widthwise and heightwise for a substantial portion of its total length toward one end, the tapered portion of each panel section measuring at least several feet lengthwise of the panel section, and the remainder of the length of each panel section being untapered widthwise and heightwise to receive telescopically the tapered portion of another panel section so as to form a smooth and stable splice between adjacent panel sections without cutting, crimping or otherwise deforming the panel sections, said slight taper of each panel section being substantially imperceptible in a finished roof and each complete panel of the roof appears to be of uniform cross section throughout its length, and a plurality of roof panel attaching and supporting clips including vertical walls arranged between opposing side walls of laterally adjacent roof panels, said clips having top oppositely extending lateral flanges engaging above top flanges of the adjacent roof panels and lower oppositely extending lateral roof panel support flanges on which the bottoms of adjacent roof panels rest, and attaching feet on said clips at an elevation substantially below said panel support flanges and adapted to be secured to the tops of purlins to provide a stand-off space and thermal break between purlins and the bottoms of the roof panels, said stand-off space adapted to receive thermal insulation.

2. In a standing T-rib roof as defined in claim 1, and a continuous longitudinal cleat covering and closed about the longitudinal edges of the top flanges of side-by-side pairs of said roof panels to hold such pairs in assembled relationship to said clips while rendering the roof weather-tight.

3. In a standing T-rib roof as defined in claim 2, and a sealant strip between the top wall of the cleat and said roof panel top flanges.

4. In a standing T-rib roof as defined in claim 1, and said clip roof panel support flanges being spaced longitudinally on each clip with the attaching foot of each clip disposed between the support flanges and integrally connected to the vertical wall of the clip by an intervening leg extension depending from the vertical wall.

5. In a standing T-rib roof as defined in claim 4, and said attaching foot of each clip being at right angles to the vertical wall of the clip and parallel to the support flanges and upper oppositely extending lateral flanges of the clip, and the attaching foot being apertured for the reception of fasteners used to anchor the foot to an underlying purlin.

6. In a standing T-rib roof as defined in claim 5, and ribbing on said attaching foot in two right angular directions to render the clip rigid.

7. In a standing T-rib roof as defined in claim 1, and the vertical wall of each clip being elongated along the lengths of adjacent roof panels, said upper oppositely extending lateral clip flanges together extending along the entire length of each clip.

8. In a standing T-rib roof as defined in claim 1, and a blanket of thermal insulating material disposed in said stand-off space between said purlins and the bottoms of said roof panels and substantially filling the stand-off space.

9. In a standing T-rib roof as defined in claim 1, and the height and width angles of taper being equal angles.

10. In a standing T-rib roof, a plurality of side-by-side elongated channel cross section roof panels, each elongated roof panel consisting of at least a pair of longitudinally telescoping panel sections, each panel section having a slight taper widthwise and heightwise for a substantial portion of its total length toward one end, the tapered portion of each panel section measuring at least several feet lengthwise of the panel section, and the remainder of the length of each panel section being untapered widthwise and heightwise to receive telescopically the tapered portion of another panel section so as to form a smooth and stable splice between adjacent panel sections without cutting, crimping or otherwise deforming the panel sections, said slight taper of each panel section being substantially imperceptible in a finished roof and each complete panel of the roof appears to be of uniform cross section throughout its length, means for attaching said plurality of side-by-side roof panels in assembled sealed relationship, and means for attaching said roof panels to underlying roof purlins.

* * * * *